US011745924B2

(12) United States Patent
Batsa et al.

(10) Patent No.: US 11,745,924 B2
(45) Date of Patent: Sep. 5, 2023

(54) SAW BLADE HOLDER

(71) Applicant: APEX BRANDS, INC., Apex, NC (US)

(72) Inventors: Stephen Mario Batsa, Lexington, SC (US); John Fiumefreddo, Lexington, SC (US)

(73) Assignee: APEX BRANDS, INC., Apex, NC (US)

( * ) Notice: Subject to any disclaimer, the term of this patent is extended or adjusted under 35 U.S.C. 154(b) by 0 days.

(21) Appl. No.: 17/679,387

(22) Filed: Feb. 24, 2022

(65) Prior Publication Data

US 2022/0274755 A1 Sep. 1, 2022

Related U.S. Application Data

(60) Provisional application No. 63/154,256, filed on Feb. 26, 2021.

(51) Int. Cl.

| | |
|---|---|
| ***A45C 11/26*** | (2006.01) |
| ***B65D 73/00*** | (2006.01) |
| ***B65D 77/24*** | (2006.01) |

(52) U.S. Cl.

CPC ..... *B65D 73/0014* (2013.01); *B65D 77/24* (2013.01)

(58) Field of Classification Search

CPC ..... B65D 73/0014; B65D 85/02; B65D 77/24
USPC ..... 206/303, 349, 806; 220/4.21–4.23, 810, 220/836

See application file for complete search history.

(56) References Cited

U.S. PATENT DOCUMENTS

| | | | | |
|---|---|---|---|---|
| 3,095,965 A * | 7/1963 | Stahl | A45D 27/22 | 220/836 |
| 6,267,239 B1 * | 7/2001 | Maki | B23D 59/00 | 206/349 |
| 6,729,468 B1 * | 5/2004 | Dobmeier | B23D 59/00 | 206/349 |
| 7,178,214 B1 * | 2/2007 | Wilson | B25B 9/00 | 29/281.1 |
| 8,746,451 B2 * | 6/2014 | Nicholls | B25H 3/006 | 206/349 |
| 2003/0102237 A1 * | 6/2003 | Curtsinger | B65D 73/0071 | 206/349 |

* cited by examiner

*Primary Examiner* — Luan K Bui
(74) *Attorney, Agent, or Firm* — BURR & FORMAN LLP

(57) ABSTRACT

A saw blade holder may include a first guard member which may include a first groove configured to receive a first portion of an edge of a saw blade, a second guard member which may include a second groove configured to receive a second portion of the edge of the saw blade, a hinge that may be configured to couple the first guard member to the second guard member such that the first guard member may rotate relative to the second guard member to transition the saw blade holder between an open position and a closed position, and a locking member that may be affixed to one of the first guard member or the second guard member, the locking member may be configured to move into a locked position to secure the first guard member to the second guard member when the saw blade holder is in the closed position.

19 Claims, 13 Drawing Sheets

SAW BLADE HOLDER

CROSS-REFERENCE TO RELATED APPLICATIONS

This application claims the benefit of U.S. Provisional Application No. 63/154,256 filed on Feb. 26, 2021, the entire contents of which are hereby incorporated herein by reference.

TECHNICAL FIELD

Example embodiments generally relate to product packaging, and in particular to product packaging for a saw blade.

BACKGROUND

Displaying saw blades, such as circular saw blades, in a retail store for purchase by customers often involves simply hanging the blade on a peg hook through a central opening in the blade. In some instances, a stack of blades of a common type may be stocked on a single peg hook. In this configuration, the blades can be difficult to separate from one other and remove from the display. Also, handling of the blades can be difficult, since the sharp edge of the blade should be avoided. Due to these drawbacks of the conventional saw blade displays, improvements to saw blade merchandising in a retail store environment is desired.

BRIEF SUMMARY OF SOME EXAMPLES

Some example embodiments may provide for a saw blade holder. The saw blade holder may include a first guard member which may include a first groove configured to receive a first portion of an edge of a saw blade, a second guard member which may include a second groove configured to receive a second portion of the edge of the saw blade, a hinge that may be configured to couple the first guard member to the second guard member such that the first guard member may rotate relative to the second guard member to transition the saw blade holder between an open position and a closed position, and a locking member that may be affixed to one of the first guard member or the second guard member, the locking member may be configured to move into a locked position to secure the first guard member to the second guard member when the saw blade holder is in the closed position.

In another example embodiment, the saw blade holder may include a first guard member which may include a first groove configured to receive a first portion of an edge of a saw blade, a second guard member which may include a second groove configured to receive a second portion of the edge of the saw blade, and a hinge which may couple the first guard member to the second guard member such that the first guard member may be configured to rotate relative to the second guard member to transition the saw blade holder between an open position and a closed position. The hinge may include a first hinge portion operably coupled to the first guard member and a second hinge portion operably coupled to the second guard member. The first hinge portion may include a post which may have a T-feature and the second hinge portion may include an aperture which may have a corresponding T-feature. The T-features of the first and second hinge portions may be configured to align when the saw blade holder is in the open position, and misalign when the saw blade holder is not in the open position.

In another example embodiment, the saw blade holder may include a first guard member which may include a first groove configured to receive a first portion of an edge of a saw blade, a second guard member which may include a second groove configured to receive a second portion of the edge of the saw blade, a hinge which may couple the first guard member to the second guard member such that the first guard member may be configured to rotate relative to the second guard member to transition the saw blade holder between an open position and a closed position, a display interface which may facilitate mounting the saw blade holder on a merchandise display, an EAS cavity which may be configured to receive an EAS tag, where at least a portion of the EAS cavity may be coupled to the first guard member or the second guard member, and a locking member which may be affixed to one of the first guard member or the second guard member and may be configured to move into a locked position from an unlocked position which may enclose the EAS cavity and secure the first guard member to the second guard member when the saw blade holder is in the closed position. The locking member may include a foldable tab which may be configured to clasp or clinch one of the free ends of the first guard member to the free end of the second guard member responsive to being folded into the locked position. The locking member may be only operably coupled to the first guard member when not in the locked position. The locking member may further include a first aperture portion which may align with a second aperture portion in the display interface when the locking member is in the locked position. The locking member may further include locking holes which may receive tabs to secure the locking member in the locked position.

BRIEF DESCRIPTION OF THE SEVERAL VIEWS OF THE DRAWING(S)

Having thus described some example embodiments in general terms, reference will now be made to the accompanying drawings, which are not necessarily drawn to scale, and wherein:

Figure 15:
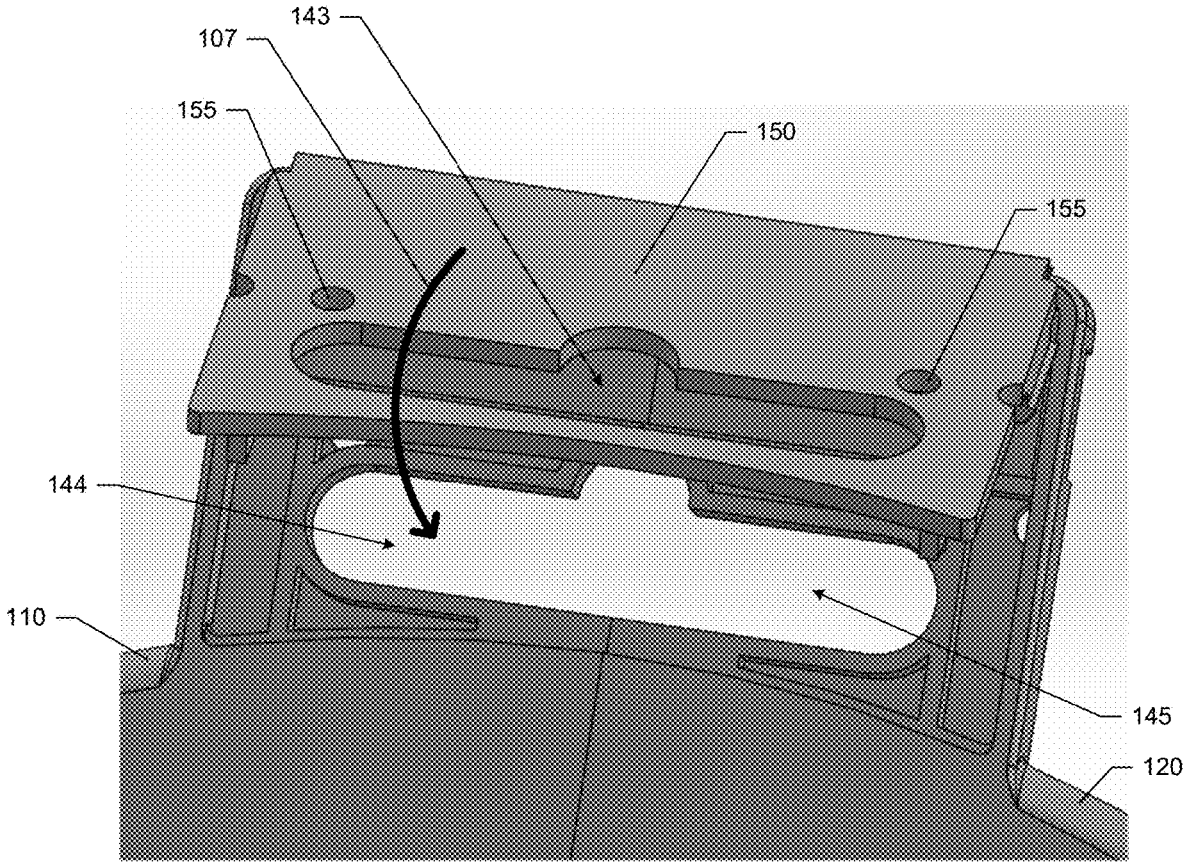
Figure 16:
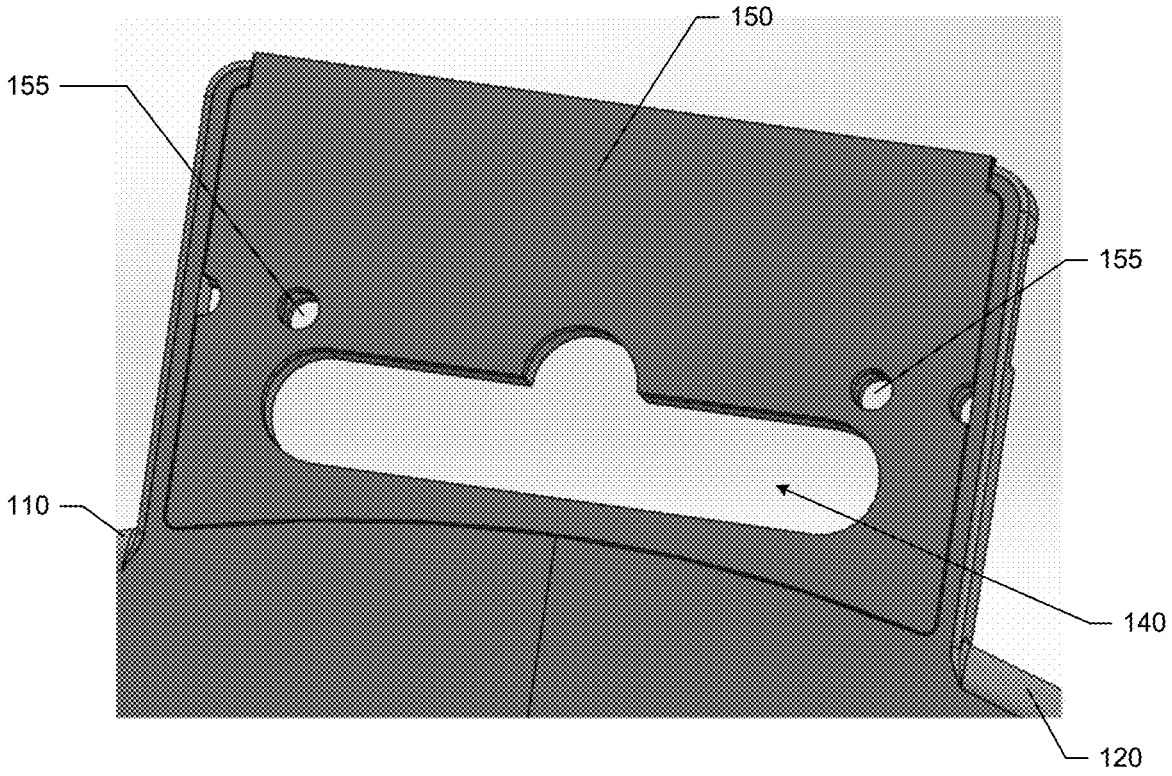

FIG. 15 illustrates a zoomed in view of components of the display interface, the EAS security assembly, and the locking member, with the guard members in a closed position and the locking member transitioning from an unlocked position towards a locked position according to some example embodiments; and FIG. 16 illustrates a zoomed in view of components of the display interface, the EAS security assembly, and the locking member, with the guard members in a closed position and the locking member in a locked position according to some example embodiments.

DETAILED DESCRIPTION

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other. As used herein, operable coupling should be understood to relate to direct or indirect connection that, in either case, enables functional interconnection of components that are operably coupled to each other.

Example embodiments of a saw blade holder are provided herein that solve a number of technical problems. In this regard, according to some example embodiments, a saw blade may be disposed within saw blade holder in a locked fashion to secure the blade within a groove of the holder that enclosed the sharpened edge of the blade to avoid accidental contact. Since the blade is locked within the holder, a risk of sharpened blade being accidentally exposed, for example, while in a retail store is reduced or prevented. Further, according to some example embodiments, the same locking mechanism that locks the blade within the grooves of the holder may also secure an electronic article surveillance (EAS) tag that operates to deter theft of the saw. As such, according to some example embodiments, a saw blade holder as provided herein may operate to both enclose and secure the sharp edge of the blade and also secure an (EAS) tag within a secure enclose to protect the tag from tampering.

In some example embodiments, a saw blade holder 100 may be configured to secure a saw blade 101 therein (e.g. a circular saw blade) for stocking in a merchandise display in a retail sales establishment. As such, the saw blade holder 100 may operate to both protect and secure the product therein in a retail sales environment. However, in some embodiments, the saw blade holder 100 may also be used to secure and maintain a saw blade 101 in a working environment of the end user, such as within a tool box, when the blade 101 is not in use in a saw.

Figure 1:
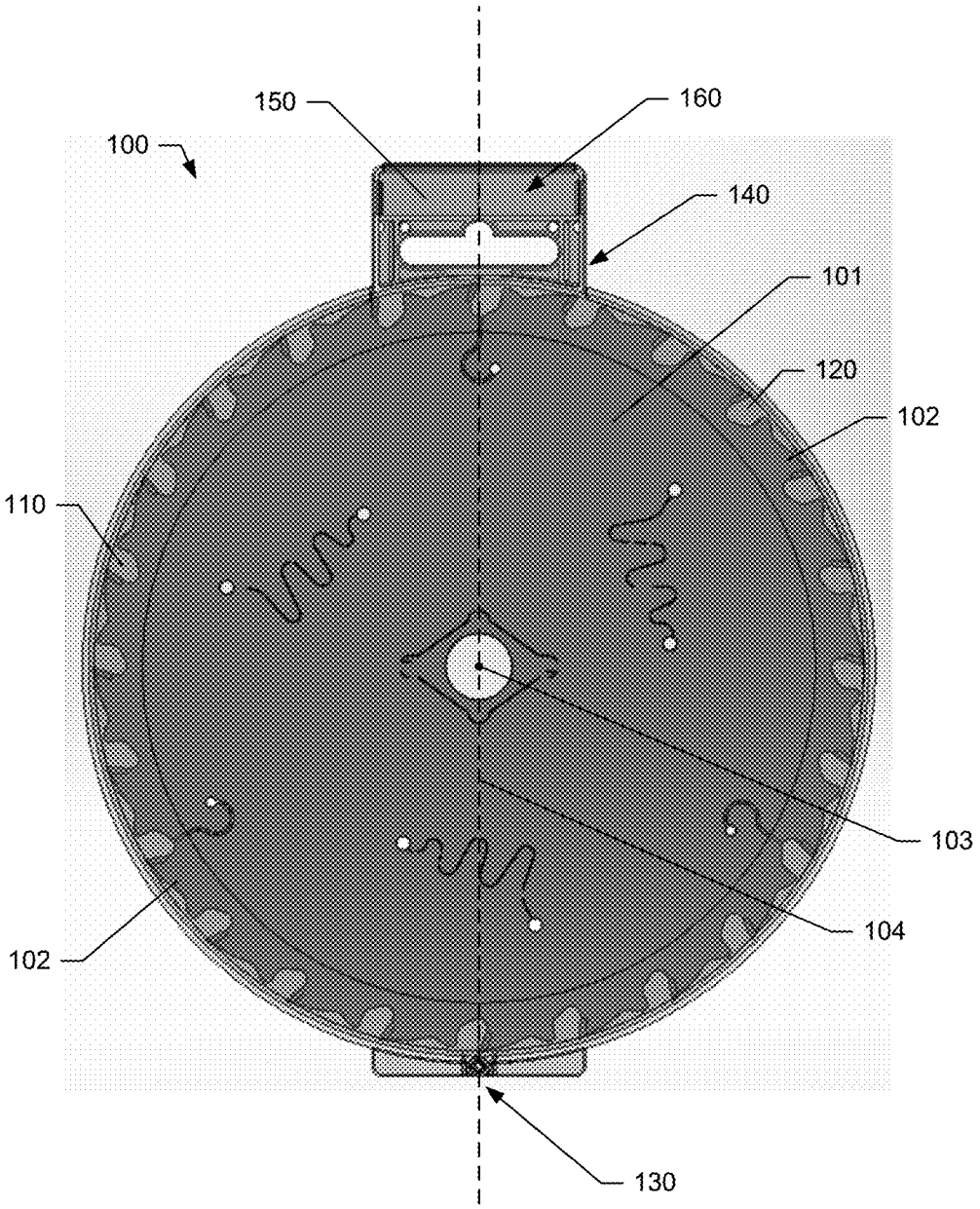
FIG. 1 illustrates an example saw blade holder with transparent guard members holding a blade according to some example embodiments.
Figure 2:
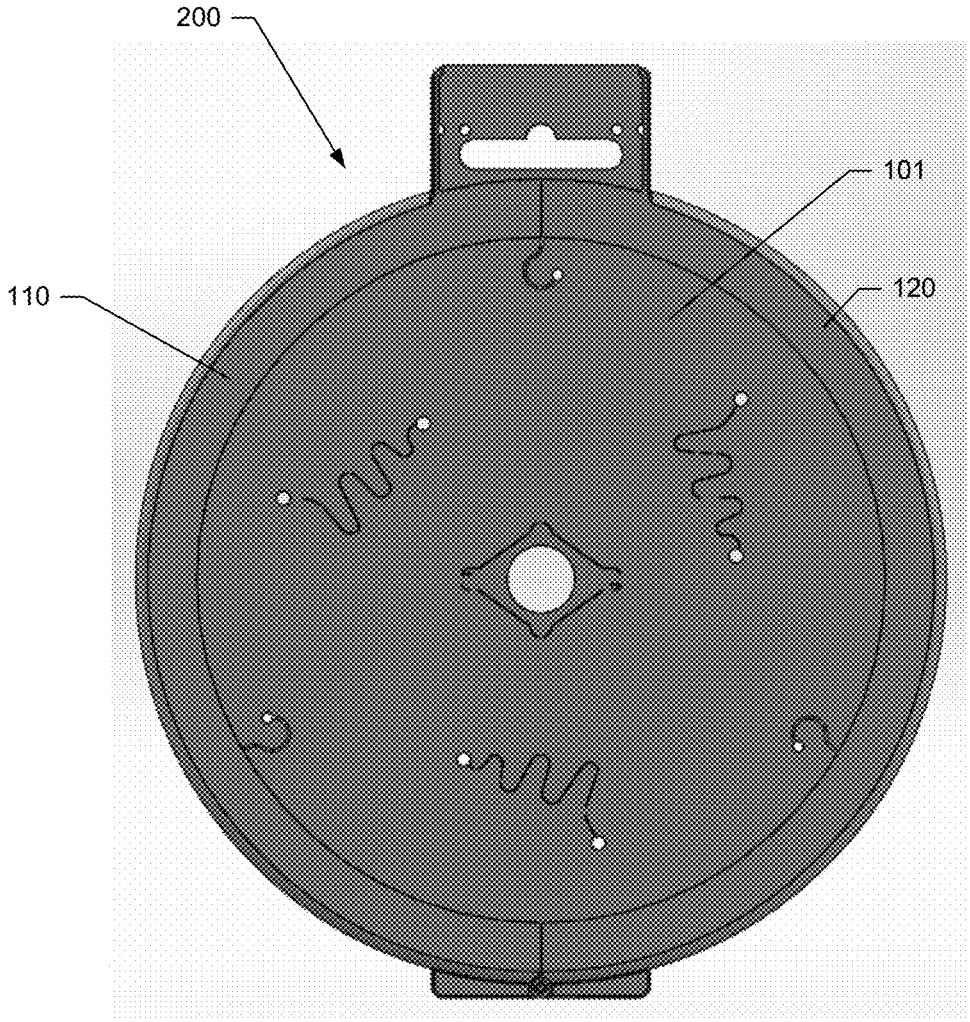
FIG. 2 illustrates an example saw blade holder with guard members holding a blade according to some example embodiments.

Referring now to FIG. 1 a saw blade holder 100 may include a first guard member 110, a second guard member 120, a hinge 130, a display interface 140, a locking member 150, and an electronic article surveillance (EAS) security assembly 160. The first guard member 110 and the second guard member 120 may each be arcuate-shaped semi-circular members, and may be configured to hold the saw blade 101 by a portion of the saw blade's edge 102. For reference, the width of the edge 102 of the saw blade 101 may be measured from a radially outermost point of a tooth of the saw blade, to a radially innermost point of a gullet in between consecutive teeth. In this regard, the saw blade holder 100 may be substantially circular in shape, however, the first and second guard members 110 and 120 may take other non-circular shapes (e.g., right-angled frame members that form a square). In some embodiments, such as the one depicted in FIG. 1, the saw blade holder 100 may be constructed from a transparent material, and thus the edge 102 of the saw blade 101 may be visible through the saw blade holder 100. In some other embodiments, such as the one depicted in FIG. 2, the saw blade holder 200 may be constructed from an opaque material, and thus the edge 102 of the saw blade 101 may not be visible through the saw blade holder 200.

The edge 102 of the saw blade 101 may be enclosed within a first groove portion 111 and a second groove portion 121 formed within each of the first guard member 110 and second guard member 120, respectively. In some embodiments, the first groove portion 111 and the second groove portion 121 may be roughly U-shaped so that the edge 102 of the saw blade 101 may fit into a middle gap of the U-shape. In some embodiments, the first and second groove portions 111 and 121 may only be deep enough to cover the edge 102 of the saw blade 101. In this regard, according to some example embodiments, the saw blade holder 200 need not extend around and cover the interior portions of the saw blade 101 that are located proximate to the center 103 and away from the edge 102. This may allow for the saw blade 101, and information disposed on the saw blade, to be examined up close without having to remove the saw blade 101 from the saw blade holder 200. It may also allow for additional branding and marketing opportunities on the saw blade 101 this is not obscured by the holder 200 or other packaging. Additionally, with the saw blade holder 200 disposed at the edge 102 of the saw blade 101 and permitting access to the center 103 of the blade 101, an operator may be able to test the fit of the saw blade 101 to a saw without having to remove the saw blade holder 200. In this regard, the saw blade holder 200 may provide a safer way to handle the saw blade 101 without entirely restricting interaction with the saw blade 101. In some cases, the saw blade holder 200, or components of the saw blade holder 200, may be formed from a rigid material, such as a plastic, through an injection molding process. Accordingly, the saw blade holder 200 may not be as costly and may be more readily produced than some conventional saw blade packaging.

Figure 3:
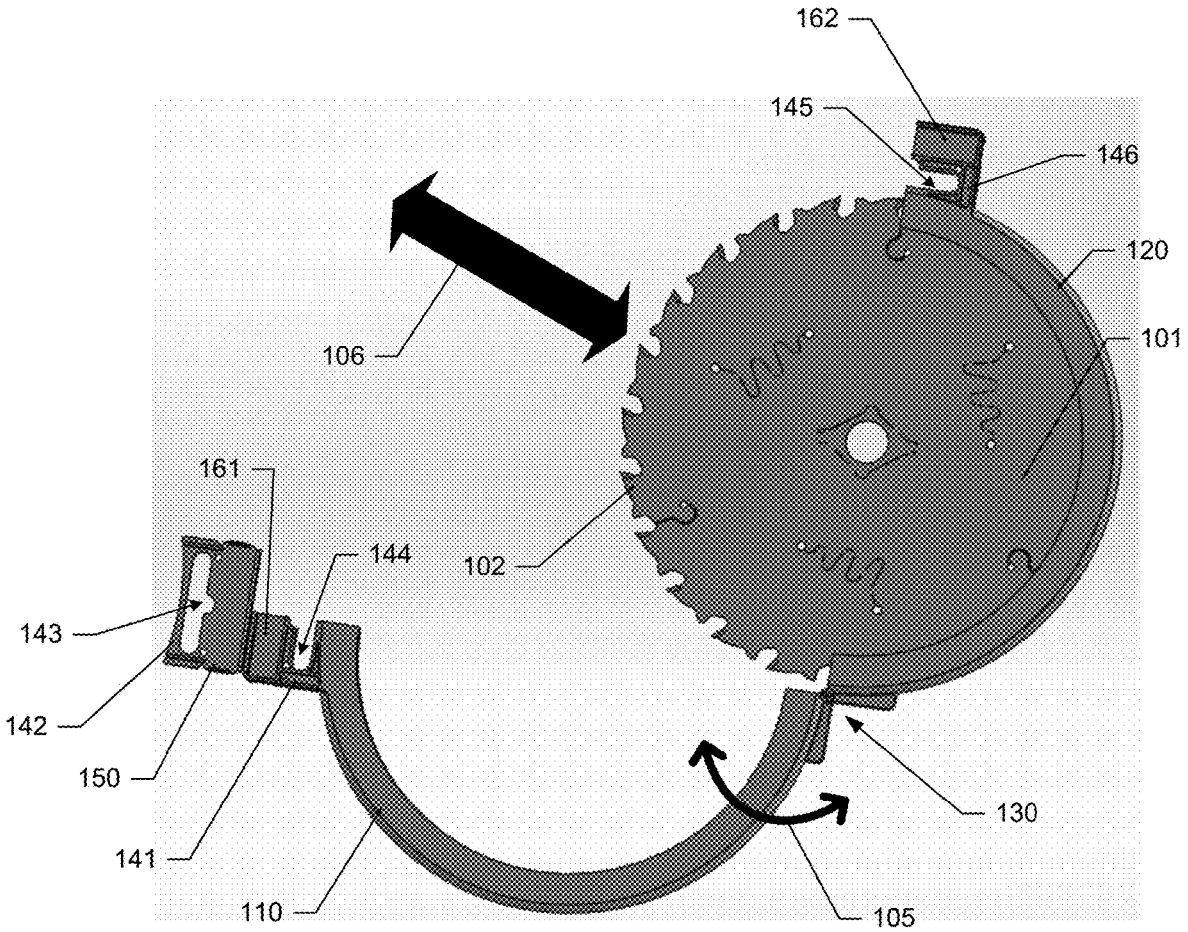
FIG. 3 illustrates a saw blade holder in an open position according to some example embodiments.
Figure 4:
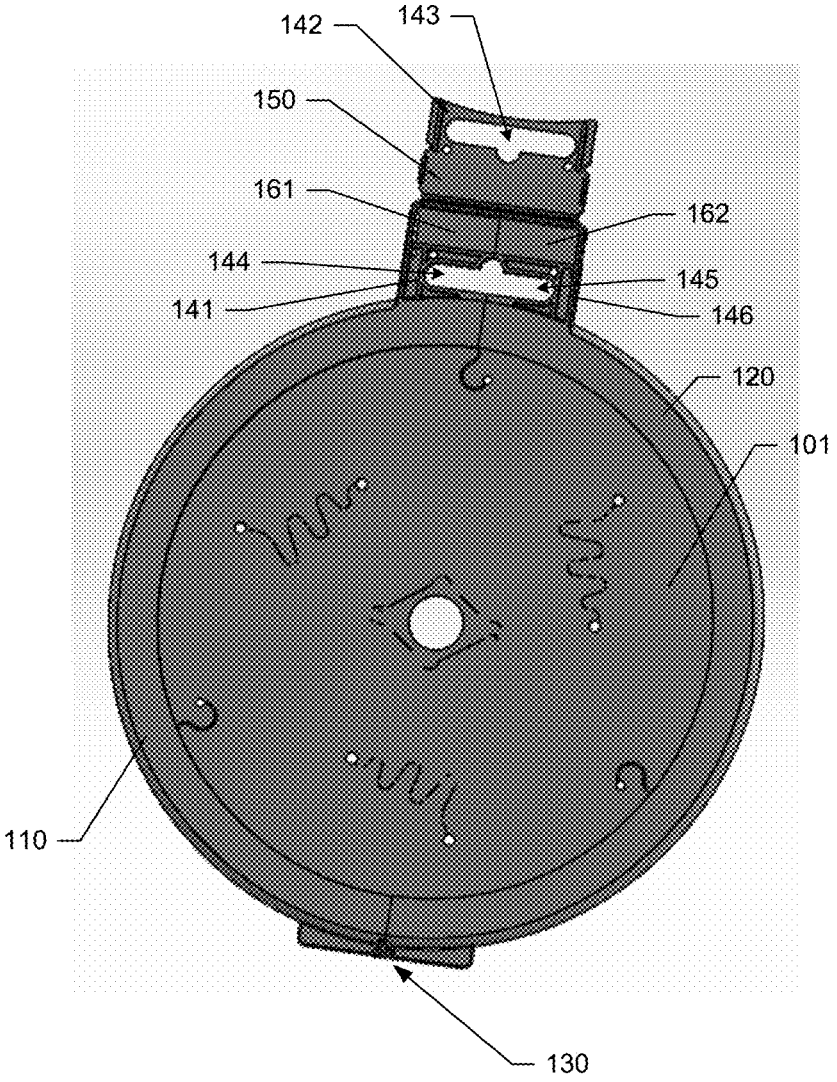
FIG. 4 illustrates a saw blade holder in a closed position with a locking member in an unlocked position according to some example embodiments.
Figure 5:
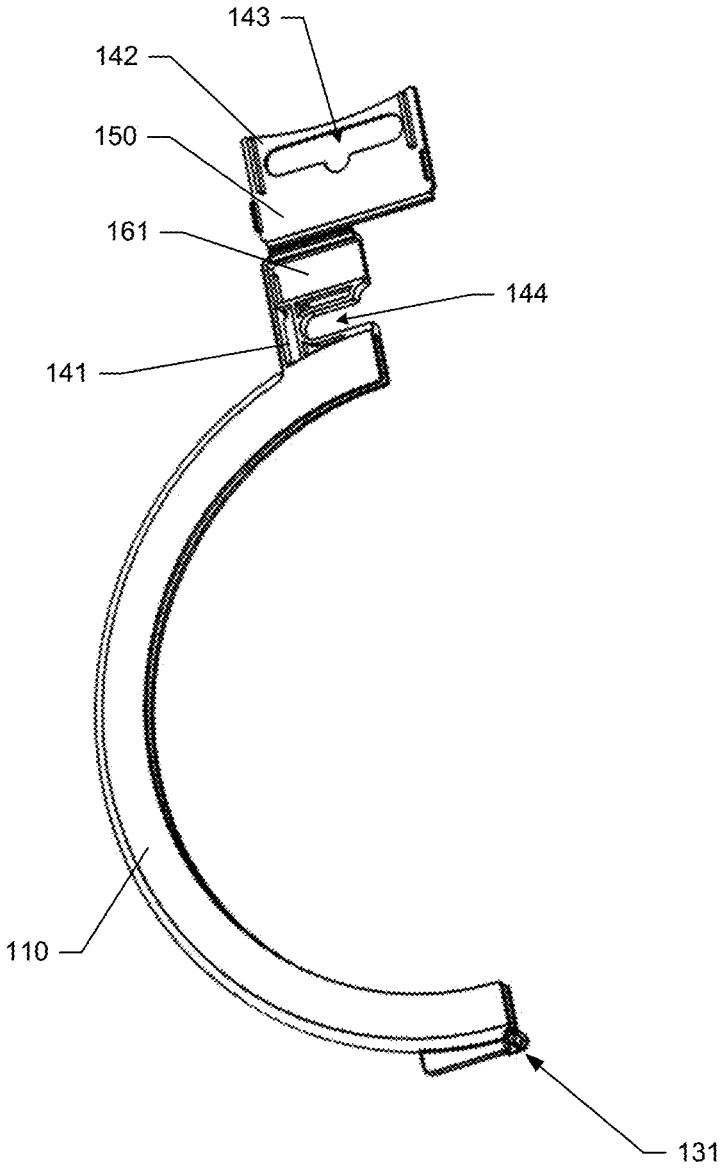
FIG. 5 illustrates a first guard member coupled with components of a hinge, a display interface, an electronic article surveillance (EAS) security assembly, and a locking member according to some example embodiments.
Figure 6:
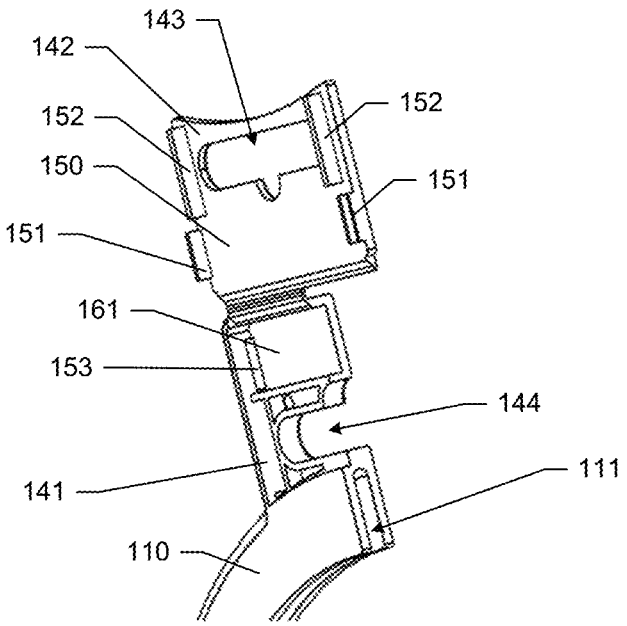
FIG. 6 illustrates a zoomed in view of components of the display interface, the EAS security assembly, and the locking member coupled to the first guard member according to some example embodiments.
Figure 7:
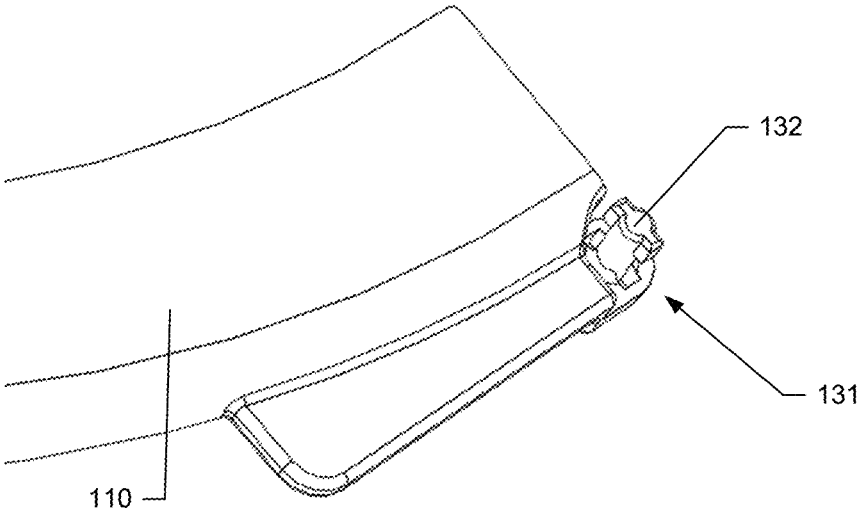
FIG. 7 illustrates a zoomed in view of components of the hinge coupled to the first guard member according to some example embodiments.
Figure 8:
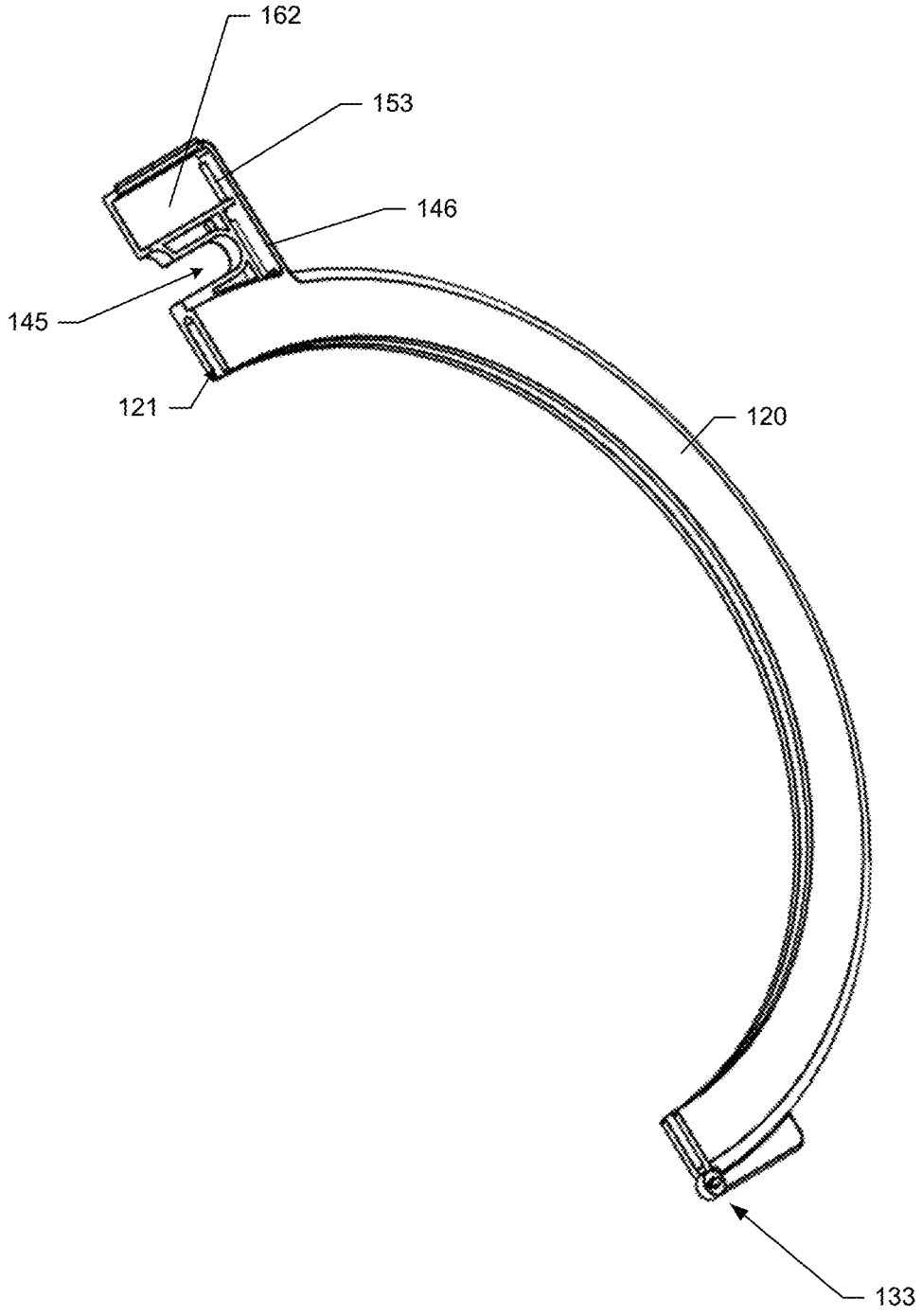
FIG. 8 illustrates a second guard member coupled with components of the hinge, the display interface, and the EAS security assembly according to some example embodiments.
Figure 9:
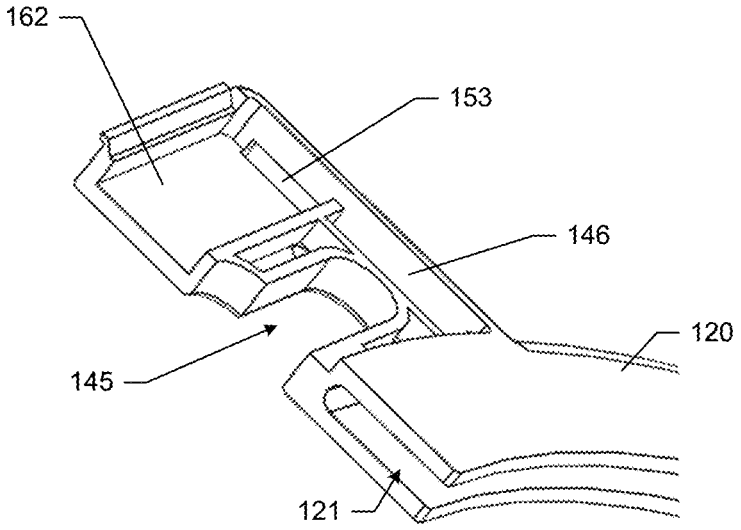
FIG. 9 illustrates a zoomed in view of components of the display interface and the EAS security assembly coupled to the second guard member according to some example embodiments.
Figure 10:
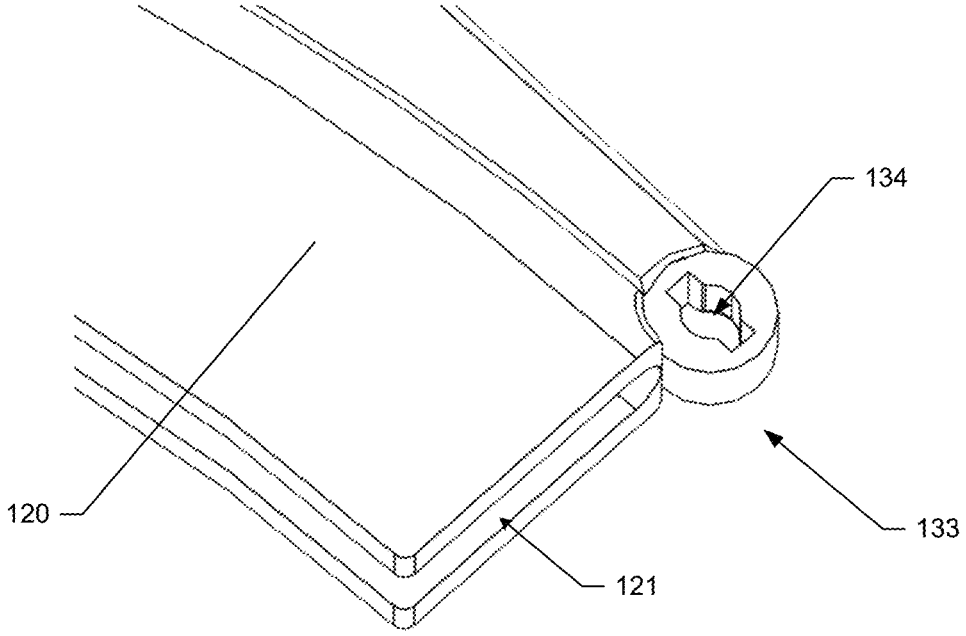
FIG. 10 illustrates a zoomed in view of components of the hinge coupled to the second guard member according to some example embodiments.

FIGS. 2-10 depict various views of the saw blade holder 200 (and the components thereof) according to an example embodiment. The first guard member 110 may be operably coupled to the second guard member 120 via the hinge 130. The hinge 130 may define a pivotable connection between the first guard member 110 and the second guard member 120 about which either the first guard member 110 or the second guard member 120 may be capable of rotating away from the other respective guard member, as indicated by arrow 105. In this regard, the saw blade holder 200 may have an open position and a closed position defined by the relative positions of the first guard member 110 and the second guard member 120. As shown in FIG. 3, in the open position the first guard member 110 may be rotated roughly 90 degrees relative to the second guard member 120. Further, according to some example embodiments, the first guard member 110 and the second guard member 120 may only contact each other at the hinge 130 when open.

In the open position, the saw blade 101 may be permitted to move relative to the saw blade holder 200. As such, the saw blade 101 may move in the direction of arrow 106 into or out of contact with either the first groove portion 111 or the second groove portion 121 of the first guard member 110 or the second guard member 120, respectively. In the closed position, the saw blade holder 200 may enclose the entire edge 102 of the saw blade 101, and thus the saw blade 101 may not be permitted to move relative to the saw blade holder 200. In some embodiments, the edge 102 of the saw blade 101 may not be visible within the first and second groove portions 111 and 121 of the first guard member 110 and the second guard member 120 when the saw blade holder 200 is in the closed position because the first and second groove portions 111 and 121 may be opaque. In some other embodiments, the first guard member 110 and the second guard member 120 may be transparent and thus the edge 102 of the saw blade 101 may be visible within the first and second groove portions 111 and 121 when the saw blade holder 100 is in the closed position. In the closed position, the first guard member 110 and the second guard member 120 may contact each other at the hinge 130 and also at an opposite side of the saw blade holder 200 from the hinge 130. Further details regarding the structure of the hinge 130 will be discussed further below.

The display interface 140, the locking member 150, and the EAS security assembly 160 of the saw blade holder 200 may all be disposed at a diametrically opposite position from the hinge 130. In some embodiments, the display interface 140 may be configured to facilitate mounting the saw blade holder 200 on a merchandise display. The display interface 140 may include a first support member 141, a second support member 146, a first aperture portion 143, a second aperture portion 144, and a third aperture portion 145. The first support member 141 may be operably coupled to the first guard member 110, and the second support member 146 may be operably coupled to the second guard member 120. Both the first and the second support members 141 and 146 may extend away from the saw blade holder 101 in a direction parallel to a center line 104 extending through the center 103 of the saw blade 101 and through the hinge 130. A third support member 142 may be disposed on the locking member 150, and may extend in a direction substantially perpendicular to the first and second support members 141 and 146 as well as the centerline 104. The first and second support members 141 and 146 may border the second and third aperture portions 144 and 145, respectively.

The third support member 142 may border both the first and second aperture portions 144 and 145 when the locking member 150 is in a locked position. In this regard, the second aperture portion 144 and the third aperture portion 145 may each comprise roughly one half of the display interface 140. Accordingly, when the saw blade holder 200 is in the closed position, the second aperture portion 144 and the third aperture portion 145 may operably couple to one another and the display interface 140 may resemble a sombrero-shape to facilitate hanging from a variety of display hooks. The first aperture portion 143, which may be proximate to the third support member 142, may be disposed on the locking member 150. The first aperture portion 143 may resemble the full sombrero-shape that the second and third aperture portions 144 and 145 may resemble when operably coupled with one another. However, in other embodiments, the display interface 140 may take any number of shapes to support hanging the saw blade holder 200 on a single-post or dual-post display hook. When the saw blade holder 200 is in the closed position, the locking member 150 may fold down in the direction of arrow 107 into a locked position to secure the first guard member 110 to the second guard member 120 and ensure proper fitment of the saw blade holder 200 on the saw blade 101. Thus, in the locked position, the first aperture portion 143 may align with the second and third aperture portions 144 and 145 to define the display interface 140 that may be configured to receive a display hook of a retail display system to permit the saw blade holder 200 to be hung from the display hook.

In some embodiments, the locking member 150 may be a foldable tab configured to move between an unlocked position and a locked position to secure the first guard member 110 to the second guard member 120, and therefore secure the saw blade 101 within the saw blade holder 200 when the saw blade holder 200 is in the closed position. To secure the first and second guard members 110 and 120 together, the locking member 150 may include tabs 151 that may be configured to interlock with locking recesses 153. In some embodiments, tabs 151 may have a barb for snap locking, possibly in a reusable fashion, within the corresponding locking recesses 153. In other cases, for example, the tabs 151 may be one-time use and embodied as posts with a mushroom end that may require the end to be cut off to unlock. In this regard, in some embodiments, the locking member 150 may be incapable of being locked again after it has been unlocked a first time. In other cases, other securing means for securing the locking member 150 into a locked position with the first and second guard members 110 and 120 may be utilized, some of which may be capable of being locked and unlocked multiple times. According to some example embodiments, the locking member 150 may include both one-time use and re-usable securing means with the one-time use securing means being used at the retail store and the re-usable securing means being used at home or at a job site.

The locking member 150 may also include guides 152. The guides 152 may be configured to align with the first and second support members 141 and 146 of the display interface 140 so that the locking member 150 properly aligns with the display interface 140 when moved into the locked position. In some example embodiments, an adhesive may be used to secure the locking member 150 in the locked position. In some cases, the locking member 150 may be welded (e.g., plastic welded) between the first and second guard members 110 and 120 in the locked position. Further, according to some other example embodiments, the locking member 150 may include holes 155 that align with corresponding holes 155 on the display interface 140 portion proximate to the first and second support members 141 and 146 when the locking member 150 is in the locked position. The holes 155 may be outfitted with respective securing devices (e.g., tie wraps, nylon cable ties, mushroom locking pegs, reusable or non-reusable clasps or clips, etc.) to secure the locking member 150 in the locked position and thus secure the free ends of the first and second guard members 110 and 120 together. Alternatively, clasps or clips may be used and/or integrated with the first and second guard members 110 and 120 to secure the first and second guard members 110 and 120 together. According to some example embodiments, any one or more than one of the securing means described herein may be used (e.g., an in-store non-reusable securing means and an at-home reusable securing means).

According to some example embodiments, the electronic article surveillance (EAS) security assembly 160 may comprise an EAS tag 170 and an EAS cavity 162 configured to receive the EAS tag 170. The EAS security assembly 160, may extend from or be a component of one or both of the first and second guard members 110 and 120. The EAS cavity may include a first portion of the EAS cavity 161 and a second portion of the EAS cavity 162 disposed on the first guard member 110 and the second guard member 120, respectively. Similar to the display interface 140, the first portion 161 and the second portion 162 may be configured to operably couple with one another to form the full EAS cavity when the saw blade holder 200 is in the closed position. However, according to some example embodiments, the EAS cavity may be partially or entirely formed in association with the first guard member 110 or partially or entirely formed in association with the second guard member 120. In other words, in some embodiments, the full EAS cavity may not necessarily comprise 50% the first portion 161 and 50% the second portion 162. The first portion 161 and the second portion 162 can each account for more or less than 50% of the full EAS cavity. For example, if the first portion 161 accounts for 30% of the full EAS cavity, then the second portion 162 would have to account for the remaining 70%. The EAS cavity may be enclosed by the locking member 150 when the locking member 150 is moved into the locked position. Accordingly, the EAS cavity may be configured to secure the EAS tag 170 to the saw blade holder 200 responsive to the locking member 150 enclosing the EAS cavity with the EAS tag 170 disposed therein. As such, the locking member 150 may perform dual functions by locking the first guard member 110 to the second guard member 120 and enclosing the EAS tag 170 in a secure space to discourage tampering with the EAS tag 170.

In some embodiments, the EAS tag 170 may be an electromagnetic oscillator that outputs a responsive wireless signal in the presence of an electromagnetic field. A gate device may output an electromagnetic field at a resonant frequency to trigger the gate device alarm if there is an attempt of theft of the saw blade holder 200 and the saw blade 101 secured therein. The EAS tag 170 may be deactivatable at the point of sale (POS) via interaction with a deactivation field to permit purchasing customers to leave a retail establishment with the saw blade holder 200 and saw blade 101 without sounding the gate alarm.

Figure 11:
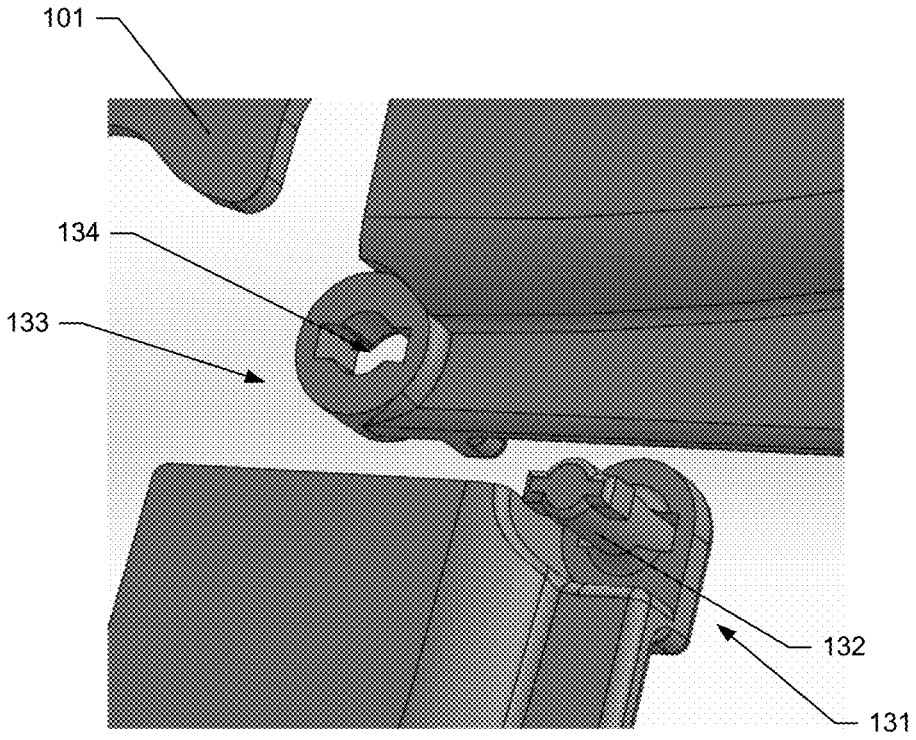
FIG. 11 illustrates a zoomed in view of components of the hinge in a separated configuration according to some example embodiments.
Figure 12:
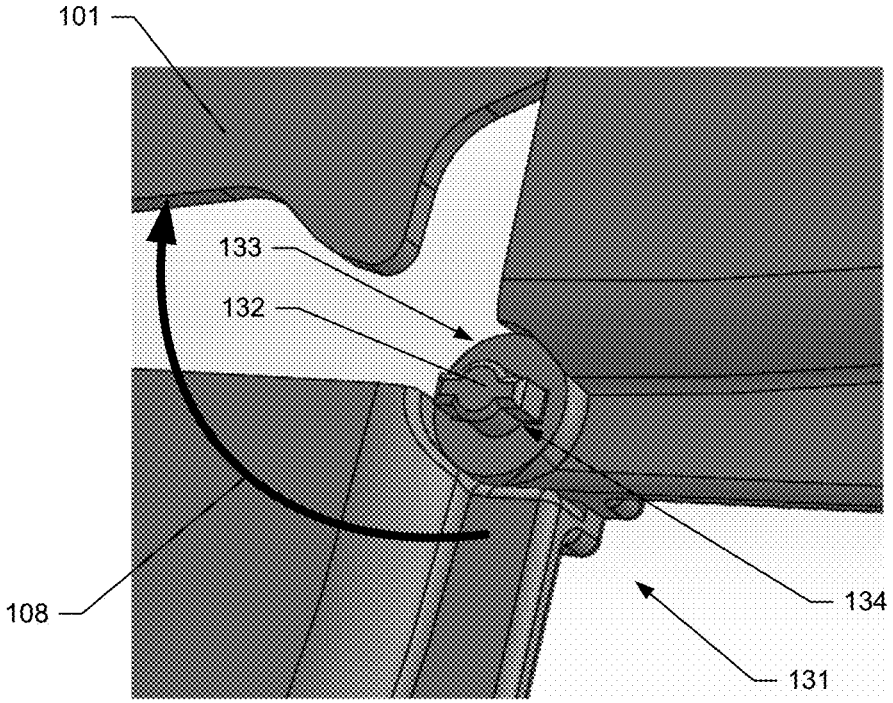
FIG. 12 illustrates a zoomed in view of components of the hinge in an engaged configuration according to some example embodiments.
Figure 13:
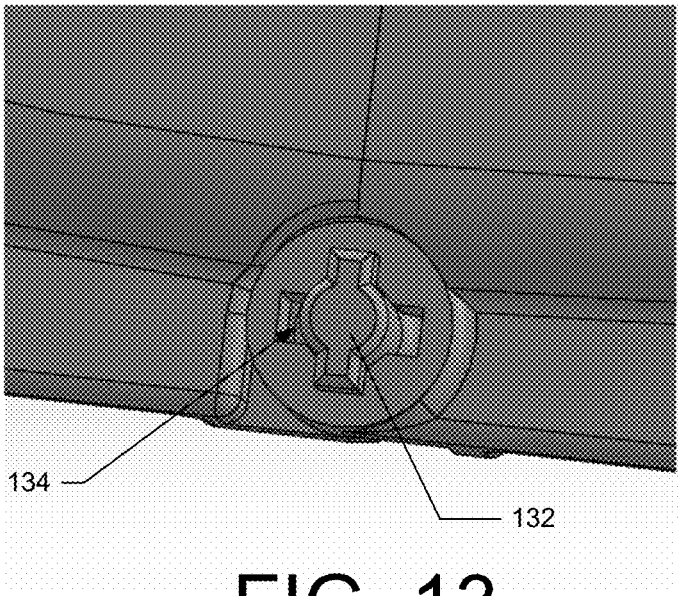
FIG. 13 illustrates a zoomed in view of components of the hinge in an engaged and secured configuration according to some example embodiments.
Figure 14:
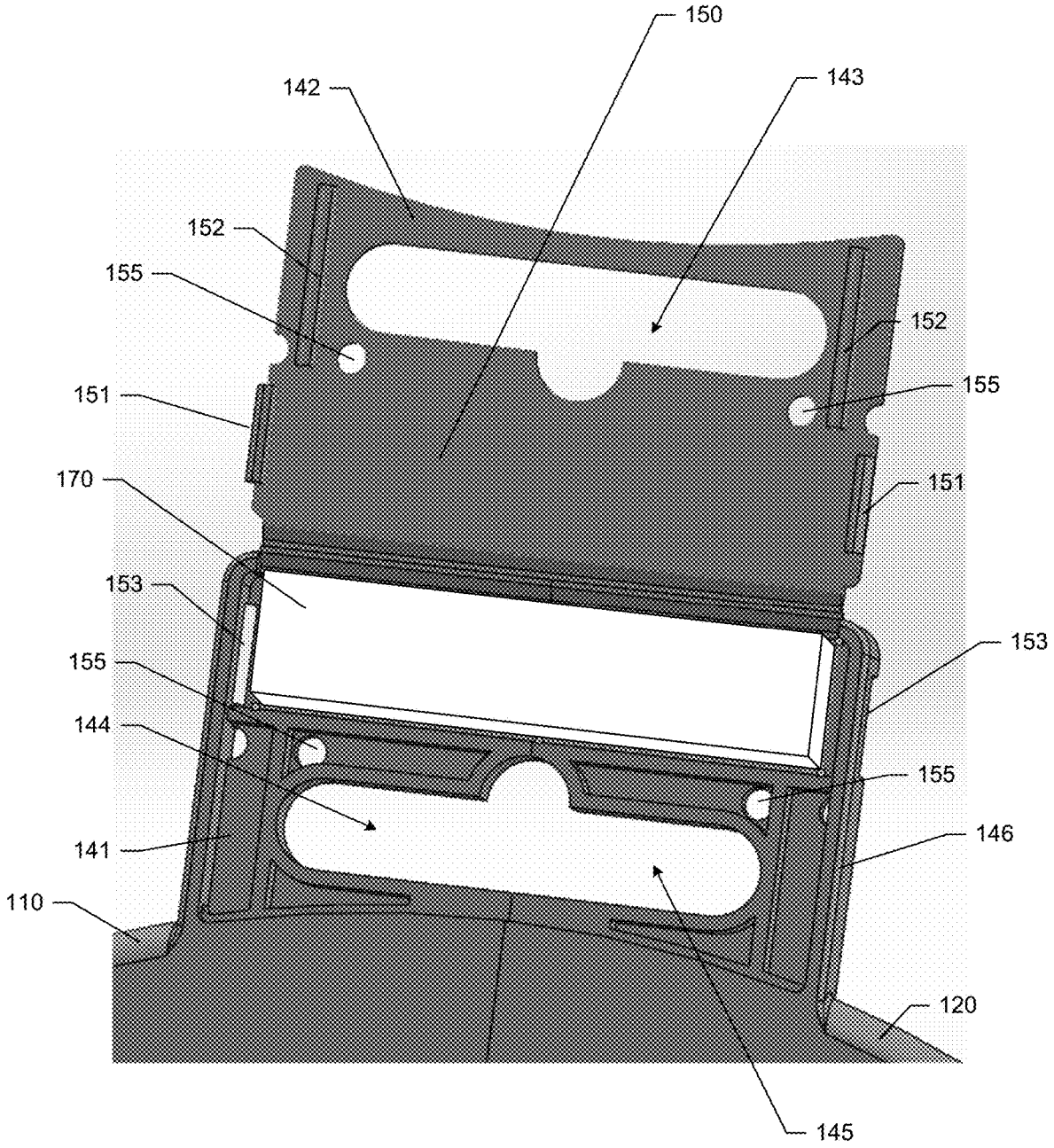
FIG. 14 illustrates a zoomed in view of components of the display interface, the EAS security assembly, and the locking member, with the guard members in a closed position and the locking member in an unlocked position according to some example embodiments.

FIGS. 11-13 depict various close-up views of the hinge 130 according to an example embodiment. The hinge 130 may include a first hinge portion 131 disposed on the first guard member 110 and a second hinge portion 133 disposed on the second guard member 120. The first hinge portion 131 may include a post 132 having a T-feature thereon. In this regard, the post 132 may resemble a cylindrical base portion with a rectangular prism embedded into a top of the cylindrical base portion. As such, the post 132 of some embodiments may resemble a T-shape in profile view. The second hinge portion 133 may include an aperture 134 with a corresponding T-feature that may be configured to operably couple with the post 132. In this regard, the aperture 134 may be shaped like a rectangle with a circular central region in order to allow the post 132 with the T-feature to be inserted therein. Accordingly, the post 132, in some example embodiments, may only operably couple with the aperture 134 in a particular orientation such that the rectangular prism on the post 132 aligns with the rectangular shape on the aperture 134 and the passage of the post 132 through the aperture 134 is permitted. Responsive to the first hinge portion 131 operably coupling to the second hinge portion 134, the first guard member 110 and the second guard member 120 may be pivotably operably coupled via the hinge 130, and thus they may pivot about an axis of rotation extending through the post 132 substantially perpendicular to a plane of a face of the saw blade 101 when the saw blade 101 is held in the saw blade holder 200. In response to the rotation of the first guard member 110 relative to the second guard member 120, the T-feature of the post 132 may become misaligned with the corresponding T-feature of the aperture 134. Accordingly, the post 132 cannot be removed when the T-feature of the post 132 is misaligned with the corresponding T-feature of the aperture 134, thereby securing the first guard member 110 to the second guard member 120 via the hinge 130. In some embodiments, the proper orientation of the first guard member 110 relative to the second guard member 120 that permits the operable coupling of the first hinge portion 131 with the second hinge portion 133 may be 90 degrees.

Some example embodiments may provide for a saw blade holder. The saw blade holder may include a first guard member which may include a first groove configured to receive a first portion of an edge of a saw blade, a second guard member which may include a second groove configured to receive a second portion of the edge of the saw blade, a hinge that may be configured to couple the first guard member to the second guard member such that the first guard member may rotate relative to the second guard member to transition the saw blade holder between an open position and a closed position, and a locking member that may be affixed to one of the first guard member or the second guard member, the locking member may be configured to move into a locked position to secure the first guard member to the second guard member when the saw blade holder is in the closed position.

The saw blade holder of some embodiments may include additional features, modifications, augmentations and/or the like to achieve further objectives or enhance performance of the extractor tool. The additional features, modifications, augmentations and/or the like may be added in any combination with each other. Below is a list of various additional features, modifications, and augmentations that can each be added individually or in any combination with each other. For example, the saw blade holder may further include a display interface that may be configured to facilitate mounting the saw blade holder on a merchandise display. In some cases, the display interface may include an aperture for receiving a display hook of the merchandise display to permit the saw blade holder to be hung from the display hook. In an example embodiment, the saw blade holder may further include an electronic article surveillance (EAS) tag, an EAS cavity which may receive the EAS tag, at least a portion of the EAS cavity may be coupled to the first guard member or the second guard member. In some cases, the locking member may enclose the EAS tag in an enclosed space formed by the EAS cavity and the locking member, when the locking member is in the locked position. In an example embodiment, in the closed position, the saw blade holder may be circular in shape. In some cases, the hinge may be disposed diametrically opposite from the EAS cavity on the saw blade holder. In an example embodiment, the locking member may include a foldable tab which may be configured to fold into the locked position to secure the first guard member to the second guard member when the saw blade holder is in the closed position. In some cases, the first guard member may include a first half of the EAS cavity and the second guard member may include a second half of the EAS cavity. In an example embodiment, the EAS cavity may be formed responsive to the saw blade holder entering the closed position. In some cases, the first half of the EAS cavity and the second half of the EAS cavity may operably couple to each other responsive to the locking member entering the locked position. In an example embodiment, the first groove and the second groove may have a depth greater than a width of the edge of the saw blade. In some cases, the hinge may include a first hinge portion which may be operably coupled to the first guard member and a second hinge portion which may be operably coupled to the second guard member. In an example embodiment, the first hinge portion may include a post that may have a T-feature and the second hinge portion may include an aperture which may have a corresponding T-feature. In some cases, the T-features of the first and second hinge portions may be configured to align when the saw blade holder is in the open position, and misalign when the saw blade holder is not in the open position.

Some example embodiments may provide for a saw blade holder. The saw blade holder may include a first guard member which may include a first groove configured to receive a first portion of an edge of a saw blade, a second guard member which may include a second groove configured to receive a second portion of the edge of the saw blade, and a hinge which may couple the first guard member to the second guard member such that the first guard member may be configured to rotate relative to the second guard member to transition the saw blade holder between an open position and a closed position. The hinge may include a first hinge portion operably coupled to the first guard member and a second hinge portion operably coupled to the second guard member. The first hinge portion may include a post which may have a T-feature and the second hinge portion may include an aperture which may have a corresponding T-feature. The T-features of the first and second hinge portions may be configured to align when the saw blade holder is in the open position, and misalign when the saw blade holder is not in the open position.

The saw blade holder of some embodiments may include additional features, modifications, augmentations and/or the like to achieve further objectives or enhance performance of the extractor tool. The additional features, modifications, augmentations and/or the like may be added in any combination with each other. Below is a list of various additional features, modifications, and augmentations that can each be added individually or in any combination with each other. For example, the saw blade holder may further include a display interface which may facilitate mounting the saw blade holder on a merchandise display. In some cases, the display interface may include an aperture for receiving a display hook of the merchandise display which may permit the saw blade holder to be hung from the display hook. In an example embodiment, the first groove and the second groove may have a depth greater than a width of the edge of the saw blade. In some cases, the saw blade holder may further include a locking member which may be affixed to one of the first guard member or the second guard member, the locking member may be configured to move into a locked position to secure the first guard member to the second guard member when the saw blade holder is in the closed position. In an example embodiment, the saw blade holder may further include an electronic article surveillance (EAS) tag and an EAS cavity which may receive the EAS tag and may be coupled to the first guard member or the second guard member. In some cases, the locking member may enclose the EAS tag in an enclosed space which may be formed by the EAS cavity and the locking member when the locking member is in the locked position. In an example embodiment, in the closed position, the saw blade holder may be circular in shape. In some cases, the hinge may be disposed diametrically opposite from the EAS cavity on the saw blade holder. In an example embodiment, the locking member may include a foldable tab which may be configured to fold into the locked position from an unlocked position to secure the first guard member to the second guard member when the saw blade holder is in the closed position. In some cases, the first guard member may include a first half of the EAS cavity and the second guard member may include a second half of the EAS cavity. In an example embodiment, the EAS cavity may be formed responsive to the saw blade holder entering the closed position. In some cases, the first half of the EAS cavity and the second half of the EAS cavity may operably couple to each other responsive to the locking member entering the locked position. In an example embodiment, the locking member may be permanently in the unlocked position responsive to being removed from the locked position.

Some example embodiments may provide for a saw blade holder. The saw blade holder may include a first guard member which may include a first groove configured to receive a first portion of an edge of a saw blade, a second guard member which may include a second groove configured to receive a second portion of the edge of the saw blade, a hinge which may couple the first guard member to the second guard member such that the first guard member may be configured to rotate relative to the second guard member to transition the saw blade holder between an open position and a closed position, a display interface which may facilitate mounting the saw blade holder on a merchandise display, an EAS cavity which may be configured to receive an EAS tag, where at least a portion of the EAS cavity may be coupled to the first guard member or the second guard member, and a locking member which may be affixed to one of the first guard member or the second guard member and may be configured to move into a locked position from an unlocked position which may enclose the EAS cavity and secure the first guard member to the second guard member when the saw blade holder is in the closed position. The locking member may include a foldable tab which may be configured to clasp or clinch one of the free ends of the first guard member to the free end of the second guard member responsive to being folded into the locked position. The locking member may be only operably coupled to the first guard member when not in the locked position. The locking member may further include a first aperture portion which may align with a second aperture portion in the display interface when the locking member is in the locked position. The locking member may further include locking holes which may receive tabs to secure the locking member in the locked position.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. A saw blade holder comprising:

a first guard member comprising a first groove configured to receive a first portion of an edge of a saw blade;

a second guard member comprising a second groove configured to receive a second portion of the edge of the saw blade;

a hinge configured to couple the first guard member to the second guard member such that the first guard member is configured to rotate relative to the second guard member to transition the saw blade holder between an open position and a closed position;

a locking member affixed to one of the first guard member or the second guard member, the locking member being configured to move into a locked position to secure the first guard member to the second guard member when the saw blade holder is in the closed position; and an electronic article surveillance (EAS) cavity configured to receive an EAS tag, at least a portion of the EAS cavity being coupled to the first guard member or the second guard member;

wherein the locking member is configured to enclose a space for the EAS tag formed by the EAS cavity and the locking member when the locking member is in the locked position.

2. The saw blade holder of claim 1, further comprising a display interface configured to facilitate mounting the saw blade holder on a merchandise display.

3. The saw blade holder of claim 2, wherein the display interface comprises an aperture for receiving a display hook of the merchandise display to permit the saw blade holder to be hung from the display hook.

4. The saw blade holder of claim 1, further comprising an electronic article surveillance (EAS) tag.

5. The saw blade holder of claim 1, wherein, in the closed position, the saw blade holder is circular in shape, and wherein the hinge is disposed diametrically opposite from the EAS cavity on the saw blade holder.

6. The saw blade holder of claim 1, wherein the locking member comprises a foldable tab configured to fold into the locked position to secure the first guard member to the second guard member when the saw blade holder is in the closed position.

7. The saw blade holder of claim 6, wherein the first guard member comprises a first half of the EAS cavity and the second guard member comprises a second half of the EAS cavity, wherein the EAS cavity is formed responsive to the saw blade holder entering the closed position, and wherein the first half of the EAS cavity and the second half of the EAS cavity operably couple to each other responsive to the locking member entering the locked position.

8. The saw blade holder of claim 1, wherein the first groove and the second groove have a depth greater than a width of the edge of the saw blade.

9. The saw blade holder of claim 1, wherein the hinge comprises a first hinge portion operably coupled to the first guard member and a second hinge portion operably coupled to the second guard member, and wherein the first hinge portion comprises a post having a T-feature and the second hinge portion comprises an aperture with a corresponding T-feature.

10. The saw blade holder of claim 9, wherein the T-features of the first and second hinge portions are configured to align when the saw blade holder is in the open position, and misalign when the saw blade holder is not in the open position.

11. A saw blade holder comprising:

a first guard member comprising a first groove configured to receive a first portion of an edge of a saw blade;

a second guard member comprising a second groove configured to receive a second portion of the edge of the saw blade; and a hinge configured to couple the first guard member to the second guard member such that the first guard member is configured to rotate relative to the second guard member to transition the saw blade holder between an open position and a closed position;

an electronic article surveillance (EAS) cavity configured to receive an EAS tag, at least a portion of the EAS cavity being coupled to the first guard member or the second guard member; and a locking member affixed to one of the first guard member or the second guard member, the locking member being configured to move into a locked position to secure the first guard member to the second guard member and enclose a space for the EAS tag formed by the EAS cavity and the locking member when the saw blade holder is in the closed position and the locking member is in the locked position, wherein the hinge comprises a first hinge portion operably coupled to the first guard member and a second hinge portion operably coupled to the second guard member, wherein the first hinge portion comprises a post having a T-feature and the second hinge portion comprises an aperture with a corresponding T-feature, and wherein the T-features of the first and second hinge portions are configured to align when the saw blade holder is in the open position, and misalign when the saw blade holder is not in the open position.

12. The saw blade holder of claim 11, further comprising a display interface configured to facilitate mounting the saw blade holder on a merchandise display, and wherein the display interface comprises an aperture for receiving a display hook of the merchandise display to permit the saw blade holder to be hung from the display hook.

13. The saw blade holder of claim 11, wherein the first groove and the second groove have a depth greater than a width of the edge of the saw blade.

14. The saw blade holder of claim 11, further comprising an electronic article surveillance (EAS) tag.

15. The saw blade holder of claim 11, wherein, in the closed position, the saw blade holder is circular in shape, and wherein the hinge is disposed diametrically opposite from the EAS cavity on the saw blade holder.

16. The saw blade holder of claim 11, wherein the locking member comprises a foldable tab configured to fold into the locked position from an unlocked position to secure the first guard member to the second guard member when the saw blade holder is in the closed position.

17. The saw blade holder of claim 16, wherein the first guard member comprises a first half of the EAS cavity and the second guard member comprises a second half of the EAS cavity, wherein the EAS cavity is formed responsive to the saw blade holder entering the closed position, and wherein the first half of the EAS cavity and the second half of the EAS cavity operably couple to each other responsive to the locking member entering the locked position.

18. The saw blade holder of claim 16, wherein the locking member is permanently in the unlocked position responsive to being removed from the locked position.

19. A saw blade holder comprising:

a first guard member comprising a first groove configured to receive a first portion of an edge of a saw blade;

a second guard member comprising a second groove configured to receive a second portion of the edge of the saw blade;

a hinge configured to couple the first guard member to the second guard member such that the first guard member is configured to rotate relative to the second guard member to transition the saw blade holder between an open position and a closed position;

a display interface configured to facilitate mounting the saw blade holder on a merchandise display;

an EAS cavity configured to receive an EAS tag, at least a portion of the EAS cavity being coupled to the first guard member or the second guard member; and a locking member affixed to one of the first guard member or the second guard member, the locking member being configured to move into a locked position from an unlocked position to enclose the EAS cavity and secure the first guard member to the second guard member when the saw blade holder is in the closed position, wherein the locking member comprises a foldable tab configured to clasp or clinch one of the free ends of the first guard member to the free end of the second guard member responsive to being folded into the locked position, wherein the locking member is only operably coupled to the first guard member when not in the locked position, wherein the locking member further comprises a first aperture portion configured to align with a second aperture portion in the display interface when the locking member is in the locked position, and wherein the locking member further comprises locking holes configured to receive tabs to secure the locking member in the locked position.

* * * * *